US007484446B1

(12) United States Patent
Gula

(10) Patent No.: US 7,484,446 B1
(45) Date of Patent: Feb. 3, 2009

(54) MANUAL PUNCH PRESS FOR KEYS

(76) Inventor: Theodore Gula, 828 S. Broom St., Wilmington, DE (US) 19805

( * ) Notice: Subject to any disclaimer, the term of this patent is extended or adjusted under 35 U.S.C. 154(b) by 354 days.

(21) Appl. No.: 11/478,773

(22) Filed: Jun. 30, 2006

(51) Int. Cl.
*B26F 1/12* (2006.01)
*B26F 1/44* (2006.01)

(52) U.S. Cl. ..... 83/414; 83/268; 83/419; 83/423; 83/467.1; 83/917; 76/110

(58) Field of Classification Search ..... 83/412–414, 83/419, 423, 454, 467.1, 681, 684, 916, 917, 83/692–695, 268; 234/1; 409/81; 269/53, 269/54, 54.4, 54.5; 76/110, 101.1, 107.1, 76/107.8
See application file for complete search history.

(56) References Cited

U.S. PATENT DOCUMENTS

| | | | | | |
|---|---|---|---|---|---|
| 894,726 | A | * | 7/1908 | Corbin | 83/413 |
| 1,615,020 | A | * | 1/1927 | Loehr et al. | 83/221 |
| 1,834,919 | A | * | 12/1931 | Altvater | 83/468.93 |
| 3,971,278 | A | * | 7/1976 | Wich | 83/413 |
| 3,981,214 | A | * | 9/1976 | Wich | 83/414 |
| 4,019,415 | A | * | 4/1977 | Wich | 83/413 |
| 4,373,414 | A | * | 2/1983 | Agius | 83/414 |
| 6,053,677 | A | * | 4/2000 | Juchinewicz | 29/76.2 |

OTHER PUBLICATIONS

Punch Sargent Blanks to Factory Specs, The National Locksmith, Jan. 2005, 9.66.*

Fun With Sargent, No More Problems With Cutting L & R Keys, D. Dennis, The Independent Locksmith Journal, (3) Jun. 2006, pp. 32-34.*

Q&A: Locksmith/Inventor Ted Gula, S. Kaufman, Locksmith Ledger International (64) No. 10, Oct. 2004, pp. 78-80.

Punch for Sargent Blanks, The Institutional Locksmith, Winter 2004-2005.

LLC Punch for Sargent Blanks, The National Locksmith, Feb. 2005, p. 33.

Punch Sargent Blanks to Factory Specs, The National Locksmith, Jan. 2005, p. 66, Feb. 2005, p. 108, Mar. 2005, p. 89, Apr. 2005, p. 76, May 2005, p. 82, Jun. 2005, p. 106.

Punch Sargent Blanks to Factory Specs, The Institutional Locksmith, Spring 2005.

Punch Sargent Blanks to Factory Specifications, Locksmith Ledger, Jul. 2005, p. 152.

Locksmithing Unlimited Sargent Punch, The National Locksmith, Jul. 2005, p. 22.

(Continued)

*Primary Examiner*—Boyer D. Ashley
*Assistant Examiner*—Edward Landrum
(74) *Attorney, Agent, or Firm*—Jeffrey C. Lew

(57) ABSTRACT

Novel modifications to a standard Pro-lok Blue Punch manual punch press machine have been developed which permit the modified machine to accurately and consistently cut Sargent brand L and R series keys to code. Modifications to the same machine are presented such that both Sargent L and R series keys may be cut to code on the same Pro-lok Blue Punch manual punch press machine. Primary features of the modifications are (1) moving the indexing stops from the lower jaw to the upward facing surface of the die and (2) providing two indexing stops on the die such that each stop is laterally positioned on opposite sides of the punch from the other.

8 Claims, 8 Drawing Sheets

OTHER PUBLICATIONS

Punch Sargent Blanks to Factory Specifications, Keynotes, Sep. 2005, p. 42.

Punch Sargent Blanks to Factory Specifications, The National Locksmith, Aug. 2005, p. 68, Sep. 2005, p. 82, Oct. 2005, p. 93, Nov. 2005, p. 83, Dec. 2005, p. 117, Jan. 2006, p. 77, May 2006, p. 87.

Industry Product News, The Independent Locksmith Journal, Feb. 2006, p. 28.

Locksmithing Uni. LLC, The National Locksmith, Nov. 2005,p. 48.

Punch Sargent Blanks to Factory Specifications, The Institutional Locksmith, Jun. 2006, p. 9.

Sargent Blue Punch, S. Dulcamaro, The National Locksmith, (77) No. 2, Feb. 2006, pp. 32-35.

Fun With Sargent, No More Problems With Cutting Sargent L&R Keys, D. DennisThe Independent Locksmith Journal, (3) Jun. 2006, pp. 32-34.

* cited by examiner

MANUAL PUNCH PRESS FOR KEYS

FIELD OF THE INVENTION

This invention relates to manual key cutting machines, and more specifically, to manual punch press machines for cutting key blanks to pre-selected lock codes.

BACKGROUND OF THE INVENTION

One of the most common services that locksmiths provide is cutting keys to fit locks. Some typical examples of many reasons for cutting keys are to replace a lost or broken key, to provide additional keys for new users of an existing lock and to provide new keys to keyholders of an existing lock that is changed for security reasons.

Very broadly described, keys are commonly cut from male blanks that have blade dimensions and profile shapes that are designed to mate with the female slot-shaped keyways of a particular manufacturer's brand and model locks. That is, a blank for a selected manufacturer's brand and model will slide into the keyways of all such brand/model locks.

For keys with an asymmetrical blade profile (sometimes referred to herein as the "side view profile" of a blade), frequently multiple cuts at uniformly separated positions along the length are made to depths of specified distances. Customarily cut depths are specified by the height of the blade remaining after a cut from the blade bottom. The longitudinal spacing between adjacent cuts and the shape of the cuts, i.e., width of cut, whether V-shaped, straight-bottomed, rounded bottomed, etc., is selected to match the space between and shape of the pins for the brand and model of lock. The specific sequence of depths of cut at respective positions along the length of the blade defines a side view profile seen as peaks and valleys. When a key is inserted into a matching brand/model lock, springs force the pins at each space position to the depth of the corresponding valley. The plug of the lock will only revolve to actuate the lock if each and every one of the pins is exactly as long as the distance between the valley and the shear line of the plug. In principle, a specific lock of a brand and model has its own unique combination of pin lengths and space positions. Consequently, only a key which allows all the pins to exactly fill the shear line-to-valley distances will operate that specific lock.

By industry convention, the positions of the cut spaces are identified in numerical sequence from key bow to tip starting with position "1". There can be any number of cut positions, however, in practice most commercially offered modern locks and keys in everyday use have about five or six set apart by a uniform center-to-center spacing. The Sargent® lock brand, with which this invention is primarily concerned, utilizes up to seven positions. Also, the depth of cut is identified in whole number units which for the Sargent brand range in designation from 1 to 10 in which "1" corresponds to no depth, i.e., the blank is not cut, and in which "10" corresponds to maximum depth. The term "depth of cut" as used herein means the distance from the top of the blade of blade material removed by the cut and is different from the customary cut depth measurement, mentioned above, that is typically used in the industry. The incremental depth of cuts is normally uniform for a given model and brand of lock. Thus a numerical sequence such as "5, 2, 6, 3, 4, 4" for example specifies a key cut configuration in which the first position is five increments deep, the second position is two increments deep, the third position is six increments deep, and so forth. Moreover, only a blank with a blade shape fitting into a manufacturer's brand "X" and model "Y" lock which is cut to a 5, 2, 6, 3, 4, 4 configuration in accordance with that brand and model spacing and depth increments will actuate the brand "X", model "Y" lock equipped with a sequence of 5, 2, 6, 3, 4, 4, 1 pins. The numerical sequence of cut depths is the key code (known in the locksmith industry as the "bitting" code for the key) of that specific lock.

The side view profile of a key code can be machined into a blank in various conventional ways. Two very common methods are cutting and punch pressing. In the former, a cutting wheel rotates against and edge of the blank. As the cutting wheel advances along the length of the blade, the wheel is moved toward and away from the blank at each cut position thereby cutting away blank material to desired depth of cut. In punch-pressing, the edge of the blank at a preselected longitudinal position is placed in the nip between appropriately shaped die and punch tool components. The punch plunges through the blank to stamp out a void corresponding to the desired depth of cut.

Non-duplicating machines for cutting key blanks, i.e., machines which do not simultaneously copy the side view profile of an existing key, are usually complex, bulky, heavy, electrically power driven. They are thus not easily transportable from site to site where a locksmith is frequently called upon to cut keys. The cutting wheels of these machines wear down with use and must be renewed and adjusted relatively frequently to maintain quality performance. Also, such machines normally can be variably controlled to operate within key cutting parameter ranges such as position spacing, depth of cut increments, widths of cut, etc. This enables one machine to cut keys of different lock manufacturers and models. Because such machines are equipped to provide broad operational flexibility, they are relatively expensive. Furthermore, as will be explained in greater detail below, a certain popular manufacturer's keys have side view profiles that even expensive electrically power driven key cutters operated by reasonably skilled technicians cannot consistently produce to code.

Manual punch presses are relatively small, light weight and portable. An example of a well known, high quality punch press key cutter is Pro-lok® "Blue Punch" key machine No. BP201 (Pro-Lok Corporation, Orange, Calif.). The Pro-lok Blue Punch machine is particularly useful because once properly adjusted, the spacing positions and the depths of cut are controlled with precision by mechanical components. As a result the effect of operator skill on achieving consistently successful key cuts is reduced.

As mentioned, the blade of the key is milled along its length to have an end view profile that uniquely mates with the female keyway of a particular brand and model of lock. By the term "end view profile" is meant the axial direction cross section shape as seen in section view FIG. 2 of the blade 1 of key blank 10 (FIG. 1). A manufacturer may choose any end view profile. Typically keys have a flat blade surface parallel to the plane of the blade on one or both sides of their end view profile near the bottom edge of the blade (region "A", FIG. 2). This facilitates clamping the blade in a holder so that a blank can be cut with a lock code. Usually keys also have irregular blade surfaces profiles near the top edge of the blade (region "B"). Stock Pro-lok Blue Punch key machines are designed to grip the blade between clamping jaws such that the flat sides of the blank blade lies flush against the opposing jaws. The plane of the blade is thus maintained perpendicular to the punch direction causing punch action to produce a cut of depth that is uniform across the full width of the blade.

Stock Pro-lok Blue Punch key machines also are factory pre-set to automatically advance the carriage holding the punch and die exactly one space position when a cut is punched. As a result, the punch is laterally aligned along the blade length to carry out the next sequential cut as soon as the operator resets the code bar to adjust fore-aft location of the jaws for proper depth of the next cut. However, stock machines are limited in that the jaw carriage of any particular machine automatically advances in only one direction, i.e., either left-to-right or right-to-left.

The ability to grip the flat surfaces of the blanks near the bottom edge and the one-direction carriage advance, among other conditions and parameters, generate a primary drawback of the Blue Punch key machine. It is that a separate machine must be used for selected lock brands and models/key series within brands. For example there are separate Blue Punch key machine models for Corbin®, Schlage®, Kwikset®, Weslock® and other brands. More specifically, the Blue Punch model BP201C70 can cut Corbin system 70, series 59 type A1, A2, B1, B2, D2, and 6 pin series 60 keys. A different Blue Punch machine is needed to cut certain Schlage keys. Because each Blue Punch machine only cuts keys for a limited selection of locks, locksmiths need to procure a large number of machines to be able to cut a wide variety of keys. Nonetheless, there has been acceptance of this machine in the market. However, it is desirable to have a punch machine capable of cutting as many different series of keys as possible.

Another drawback of all known conventional punch press machines and one from which the Blue Punch key machine also suffers prior to this invention is the inability to cut Sargent® brand keys. Sargent locks have pins with a 51 mil (0.051 inch) wide flat bottom and a 78-79° bottom angle. The depth of cut increment for a Sargent key is 20 mils (0.020 inch) and the inter-position spacing is 156 mils (0.156 inch). Cumulatively, these specifications impose a prohibitively small maximum adjacent cuts ("MACS") limitation on the key cutting machine of seven. That is, it is normally not possible to have a difference of cut depths of eight units or more (8×20 mils=160 mils) between successive cut positions. When stamping out a greater adjacent cut difference of 8 or 9 units, the punch width extends laterally beyond the position spacing of the deeper cut and removes key material of the adjacent shallower cut. In effect, that shallow cut becomes deeper than called for by the code and therefore the pin at that position will prevent the plug from turning. Sargent keys having codes which contain the sequences "1,9", "9,1", "1,10", "10,1", "2,10" and "10,2" cannot routinely and consistently be cut by any punch presses or electric code machines.

Although traditional cutting machines may be able to cut to code Sargent brand keys with MACS values of seven, in commercial practice even highly trained and skilled technicians using advanced electrically driven cutting machines typically experience poor consistency and quality. Consequently, other than by purchasing replacement keys from the original equipment supplier, and now by using this invention, there is no known device for or method of reliably obtaining Sargent keys cut to code. Sargent keys with MACS as high as seven are in service and there is a need for locksmiths to cut such key codes.

It is desirable to have a manual and portable punch press machine that is capable of consistently cutting Sargent keys to code. Notwithstanding the difficulties presented by the geometry of Sargent brand keys and locks, it is now been discovered that certain modifications to the Pro-lok Blue Punch key machine can enable the cutting of common Sargent keys with a MACS as high as seven. Thus in one aspect, this invention relates to a manual punch press for cutting selected Sargent keys to all commercially encountered codes.

Two of the most popular of Sargent brand lock styles are the "L" and "R" series. Curiously they utilize blade end view profiles that are mirror images of each other. Given the limitations that flat sides of the blade are clamped by parallel facing jaws, and that the punch and die assembly advances laterally in only one direction, it would not be expected to cut both L and R series Sargent keys in a single Pro-lok Blue Punch key machine. To increase locksmithing productivity it is highly desirable to have ability to cut Sargent series L and R keys to code on a single punch press machine.

SUMMARY OF THE INVENTION

Novel modifications to a standard Pro-lok Blue Punch manual punch press machine have been developed which permit the modified machine to accurately and consistently cut Sargent brand L and R series keys to code. Modifications to the same machine are presented such that both Sargent L and R series keys may be cut to code on the same Pro-lok Blue Punch manual punch press machine. Primary features of the modifications are (1) installing indexing stops on the upward facing surface of the press machine die and (2) providing two indexing stops on the die such that each stop is laterally positioned on opposite sides of the punch from the other stop.

Accordingly, the present invention provides in a manual press for cutting a key blank having a bow defining shoulders having a shoulder thickness, and a relatively narrow elongated blade adjacent the bow which defines a longitudinal axis of the key blank and a plurality of cut positions along the axis separated by a between center cut spacing, the press comprising (a) a jaw assembly comprising a lower jaw and an upper jaw operative to removably clamp the blade therebetween such that a cantilevered edge of the blade to be cut extends forward of the jaw assembly, (b) a carriage automatically movable in one lateral direction parallel to the axis in successive steps of the between center cut spacing, (c) a punch with a male cross section plunge motion-mounted in a holder on the carriage, and (d) a die mounted on the carriage, the die having a substantially flat upper surface comprising an elevated platform supporting one side of the cantilevered edge of the blade, the die defining a rearward indented receiving channel complementary in shape to the punch cross section such that manual lever actuation is effective to plunge the punch toward the die through the cantilevered edge of a blade positioned within a nip between the punch and die into the receiving channel, effectively to cut a notch in the edge, in which the improvement comprises the die having two indexing stops protruding upward perpendicular from the surface by an elevation distance of about the shoulder thickness and positioned at a distance from the jaw assembly effective to bias against a shoulder of a key blank clamped in the jaw assembly, and in which each indexing stop is disposed on a laterally opposite side of the slot from the other indexing stop.

This invention also provides a method of cutting a key to a bitting code comprising the steps of (A) providing a series "L" or series "R" Sargent key blank having a top shoulder, a thickness and a blade having a bottom edge and a top edge, there further being a bow at one end of the blade and a tip at the opposite end, (B) providing a Pro-lok Blue Punch BP201 manual key cutting punch press machine body free of code bar, key gauge, upper jaw, lower jaw, die and punch, the machine comprising a punch and die carriage adapted to advance in multiple uniform steps of 0.156 inch in one lateral direction from a home position, (C) providing a punch having a cutting tip defining a V-shape with an internal angle of 79 degrees and a flat bottom of 0.052 inch wide, and a die defining a slot having a cross section complementary to the V-shape of the punch, and mounting said punch and die on the carriage such that the punch meets the die at a nip, in which the die comprises a substantially flat horizontal surface and two indexing stops elevated above the surface of the die to a height greater than the thickness of the blank, the indexing stops being located laterally on opposite sides of the punch from each other, (D) providing and installing on the machine body a jaw assembly comprising an upper jaw and a lower jaw operative to clamp a bottom edge of the key blank between said upper jaw and said lower jaw, in which the lower jaw defines a forward facing wall, (E) providing and inserting into the machine body a code bar having front and back edges skewed effectively to move the jaw assembly forward toward and rearward away from the carriage in discrete whole number multiples of an incremental depth of cut of 0.020 inch, (F) adjusting the position of the code bar to move the jaw assembly forward proximate to the nip, (G) moving the carriage to one a lateral extent of travel, (H) simultaneously forcing the bottom edge of the blade against the wall of the lower jaw, biasing the top shoulder of the blank against an outboard face of one of the indexing stops and clamping the bottom edge of the blade between the upper and lower jaws such that the top edge of the blade cantilevers forward toward the nip, (I) moving the jaw assembly forward or rearward by readjusting the position of the code bar such that the top edge of the blade extends into the nip to a distance corresponding to a depth of cut of the bitting code, (J) pressing the punch to plunge the cutting tip downward through the blade at the nip thereby creating a cut at a lateral position on the blade, (K) releasing the punch upward away from the blade and advancing the carriage laterally one step, (L) repeating steps (I)-(K) there by cutting a series of cuts at lateral positions on the blade corresponding to a bitting code, and (M) unclamping the key from the jaw assembly.

DETAILED DESCRIPTION OF THE INVENTION

Figure 1:
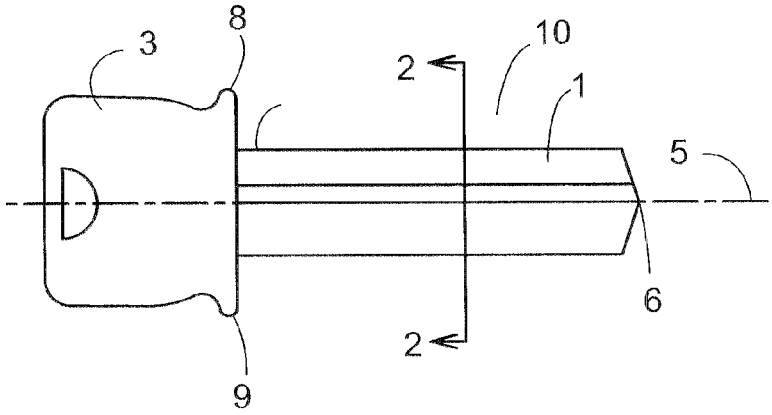
Fig. 1 Prior Art
FIG. 1 is a plan view of a key blank prior to cutting.
Figure 2:
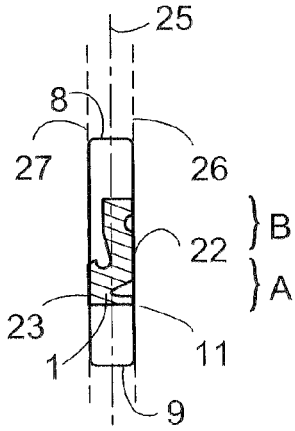
Fig. 2 Prior Art
FIG. 2 is a section view of the key blank of FIG. 1 taken through line 2-2.

The conventions for identifying various parts of keys can be understood with reference to FIGS. 1-4. In the drawings, like parts have the same reference numbers. An uncut key blank 10 is seen to have an elongated blade 1, a bow 3 at one end for a hand to hold and to manipulate the key when in a lock, and a tip 6 at the opposite end. The bow flares outward at its junction with the blade so as to form shoulders 8 and 9. The blade defines a central longitudinal axis, 5. As viewed in FIG. 1 elements vertically above the axis are referred to as "top", "upper" and the like, and similarly, elements below the axis are referred to as "bottom", "lower" and the like. For example, shoulder 8 is designated the top shoulder and element 7 is the top edge of the blade. FIG. 2 shows the end view profile of the blade 1 at cross section 2-2. The blank has a vertical axis 25. Sides of the blade are milled such that the blade end can insert into a complementary keyway for the corresponding lock.

FIG. 2 depicts an end view profile in which the sides of the blade near the bottom shoulder 9 have characteristic flat surfaces 22 and 23 that define respective planes 26 and 27. The planes are parallel to the vertical axis 25. Farther away from the bottom shoulder 9 and nearer the top shoulder 8, the sides of the blade are milled to a narrower thickness. The milled sides incorporate grooves and ridges such that the blade near the top shoulder has no characteristic flat surfaces defining planes parallel to the vertical axis 25.

Figure 3:
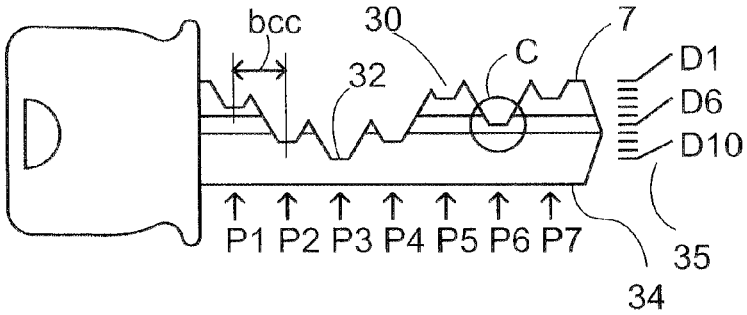
Fig. 3 Prior Art
FIG. 3 is a plan view of a key blank after cutting to a code.
Figure 4:
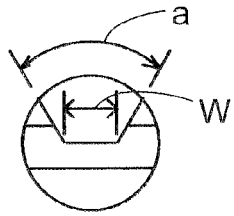
Fig. 4 Prior Art
FIG. 4 is a detail view of area C of the key of FIG. 2.

FIG. 3 shows the side view profile of a cut key 30. Seven positions designated P1-P7 of the flat bottomed cuts 32 are seen to be displaced in sequence from bow to tip by a uniform center-to-center distance bcc, usually referred to as the "between center cut" distance. A detailed view of one cut is illustrated in FIG. 4. The detail view shows that the side view profile of the cut has V-shaped slopes defined by an intersecting angle a and a flat valley defined by width w. The valleys of the seven cuts are at preselected depths from the top edge 7 of the blade. To further this explanation, a scale 35 having 10 depth of cut positions is shown to the right of the cut key. The scale indexing marks are equally spaced apart by the incremental depth of cut. Index mark labeled D1 is vertically aligned with the top edge 7 and represents 0 increments of cut depth corresponding to a numerical depth code of 1. Index marks D6 and D10 are labeled to identify the depths of 5 and 9 incremental depths of cut, having numerical depth codes of 6 and 10, respectively.

Figure 5:
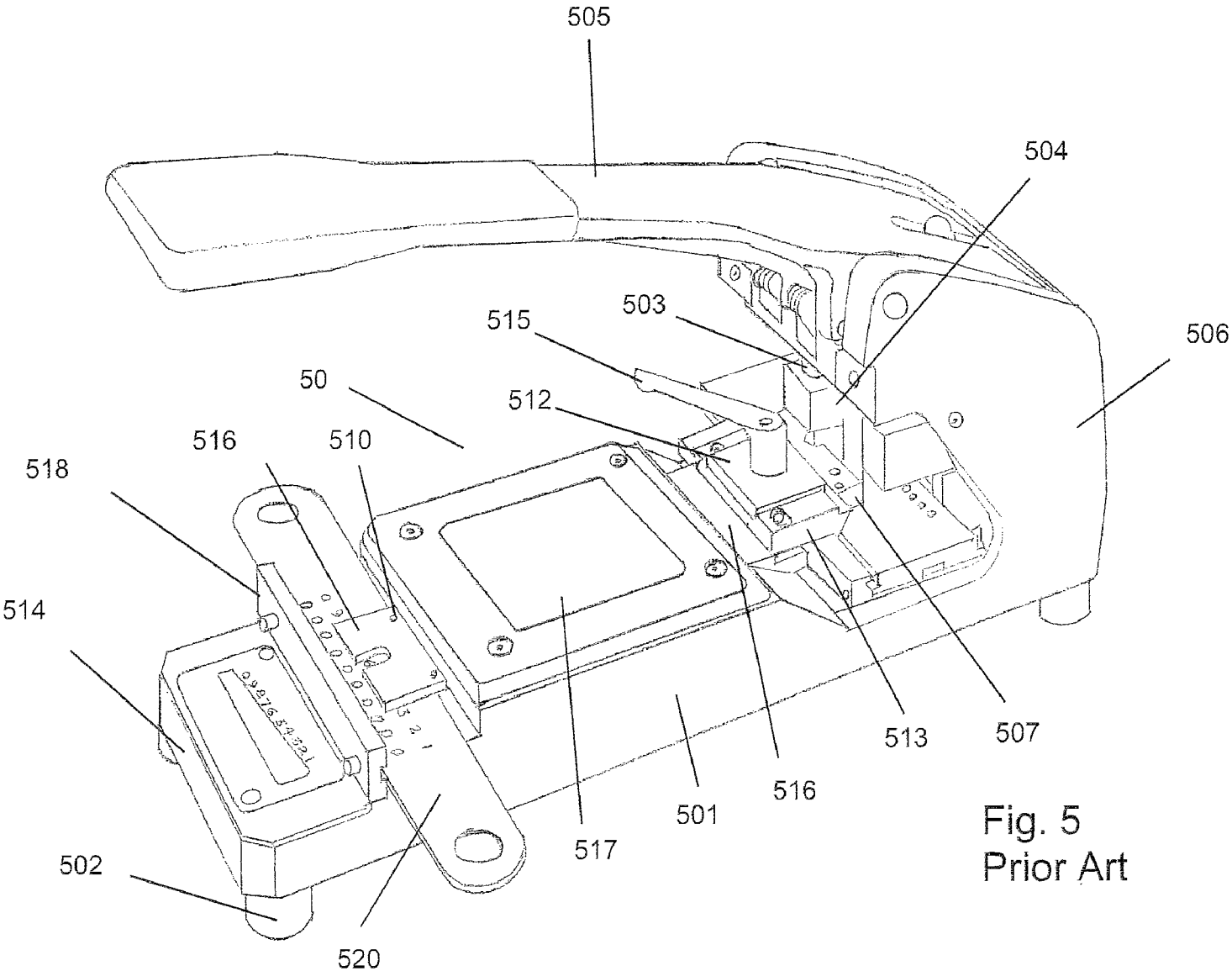
Fig. 5 Prior Art
FIG. 5 is a perspective view of an unmodified Pro-Lok Blue Punch Press key cutting machine.

A prior art, (i.e., unmodified according to this invention) Pro-lok Blue Punch manual punch press machine 50 is shown in FIG. 5 to illustrate the juxtaposition of important components. The punch press has a sturdy frame 501 and legs 502 for placing the frame on a table top or equivalent work surface. The machine is light enough to be carried to any work site and does not require other than manual power to operate. The generally cylindrical punch 503 is mounted in a holder 504 (FIG. 7) such that the punch can slide vertically downward under pressure from a bearing biased against the top of the punch when the operator manually depresses the handle 505. The handle pivots about a transverse axis positioned at an upper end of an extension 506 integral to the frame 501. The die 507 is located below the punch. It has a receiving channel with cross section complementary to that of the punch 503 such that the downward moving punch is received into the channel of the die. Springs maintain the punch and handle in an upward position such that there is a gap between the cutting tip (i.e., lower end) of the punch and the die until the handle is depressed. A key blank to be cut is clamped between an upper jaw 512 and a lower jaw 513. The top edge of the key blank faces in the forward direction toward the punch and die while the bottom edge of the key blank faces rearward toward the aft end 514 of the frame where the operator stands during operation. The jaws are clamped around the key blank by rotating a vertical screw threaded shaft in the jaws by manipulation of clamping handle 515.

The jaw assembly with key clamped within can be moved forward and rearward (i.e., away from and toward the aft end 514 of the frame, respectively). A forward-rearward sliding bar 516 lies below a cover plate 517 in the central section of the frame 501. The forward end of the bar abuts the rear side of the jaw assembly. Pins 510 connected to bar 516 bear against a forward facing edge of code bar 520. The code bar biases against a backing plate 518 mounted on the frame. The forward face of the backing plate is aligned perpendicular to fore-aft axis of the frame.

Figure 6:
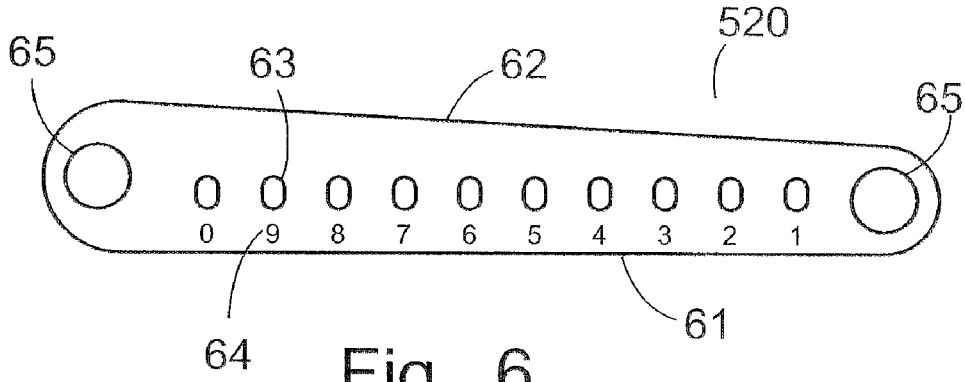
Fig. 6 Prior Art
FIG. 6 is a plan view of a code bar for a Pro-lok Blue Punch Press key cutting machine.

FIG. 6 illustrates the code bar 520 in plan view. The code bar is a solid rigid member of uniform thickness. The rear edge 61 is intended to slide laterally (i.e., left-right) against the forward face of the backing plate 518. The forward edge 62 is skewed in relation to the rear edge 61. The code bar can have optional large holes 65 near the ends for grips to facilitate manipulating the bar in the machine. A series of small elongated holes 63 are spaced apart from each other and positioned along a line parallel to the rear edge of the code bar. The holes are labeled with marks 64 typically etched into the surface of the bar with the digits 0, 9, 8, 7, 6, 5, 4, 3, 2 and 1. In operation the code bar 520 is inserted under the rear end of sliding bar 516 between pins 510 and the backing plate 518. An upward directed spherical bead of diameter slightly larger than that of the small holes 63 is mounted within the frame vertically beneath the code bar. The bead is spring-loaded to protrude above the surface of the frame on which the code bar rests and is aligned with the parallel line of holes 63. As the code bar is moved laterally while in contact with the backing plate, the bead is depressed below the frame surface by the code bar. The bead can spring upward when one of the holes 63 aligns with it. When the bead rises, it inserts into a hole and resists lateral movement of the code bar. Increased lateral force on the code bar depresses the bead and allows the code bar to move farther left or right. Thus the system of holes and bead is capable of temporarily locking the code bar in discrete lateral positions.

The sliding bar 516 is biased by spring action along the skewed edge 62 of the code bar. The greater the width of the code bar between the backing plate and the sliding bar, the farther that the jaw assembly is pushed forward toward the punch and die. The slope of the skew is preselected and the machine is adjusted such that the distances between adjacent holes corresponds to moving the sliding bar one unit of depth of cut. Once properly adjusted, the jaws will be automatically positioned forward-rearward under the nip of the punch and die to a desired depth of cut equal to the number of the hole locked by the bead. Thus, for example, to make a cut for code number "6" of depth of 5 incremental units downward from the top edge of the blank, the operator slides the code bar to catch the hole with label "6" on the bead. (Note that 5 incremental units down corresponds to reference depth "D6" illustrated in FIG. 3. By convention, the label "0" on the code bar represents reference depth "D10", which is equal to 9 incremental units downward from the top edge.) The skew of edge 62 forces the sliding bar forward effectively to place a key blank suitably clamped in the jaw assembly in position under the punch to receive a cut to code "6". After each punch, the operator can position the code bar to lock on an appropriate hole to set the next depth of cut. In short, the numbers on the code bar correspond to respective key code numbers except that "0" identifies code number "10".

In a preferred embodiment suitable for Sargent keys, the holes 63 are each 0.1240 inch wide and 0.1740 long. Relative to hole No. "0" (FIG. 6) the centerline to center line distances to hole "1", to hole "2", to hole "3" etc. are 0.4379 inch, 0.8610 inch, 1.3350 inch, 1.8060 inch, 2.2120 inch, 2.5950 inch, 3.0420 inch, 3.5150 inch, and 4.070 inch. The skew of the code bar is set such that the incremental depth of cut is 0.020 inch. The distance between the top and bottom edge of a Sargent key blank is 0.330 inch. Depths of cut are customarily measured from the bottom edge of the key blank. Accordingly, a code number "1" depth cut which corresponds to no metal cut from the top edge of the blank is a depth measurement of 0.330 inch. No. "2", "3", "4" . . . "10" depths of cut correspond respectively to 0.310, 0.290, 0.270, 0.250, 0.230, 0.210, 0.190, 0.170 and 0.150 inch between the bottom edge 34 (FIG. 3) and the flat bottom 32 of the corresponding cut.

Throughout this disclosure dimensions are specified for various parts. The tolerances for successful locksmithing in general are very low. It should therefore be understood that all dimensions disclosed herein are intended to be exact to within a plus or minus 0.001 inch, unless otherwise stated or evident to one of ordinary skill in the art.

Figure 7:
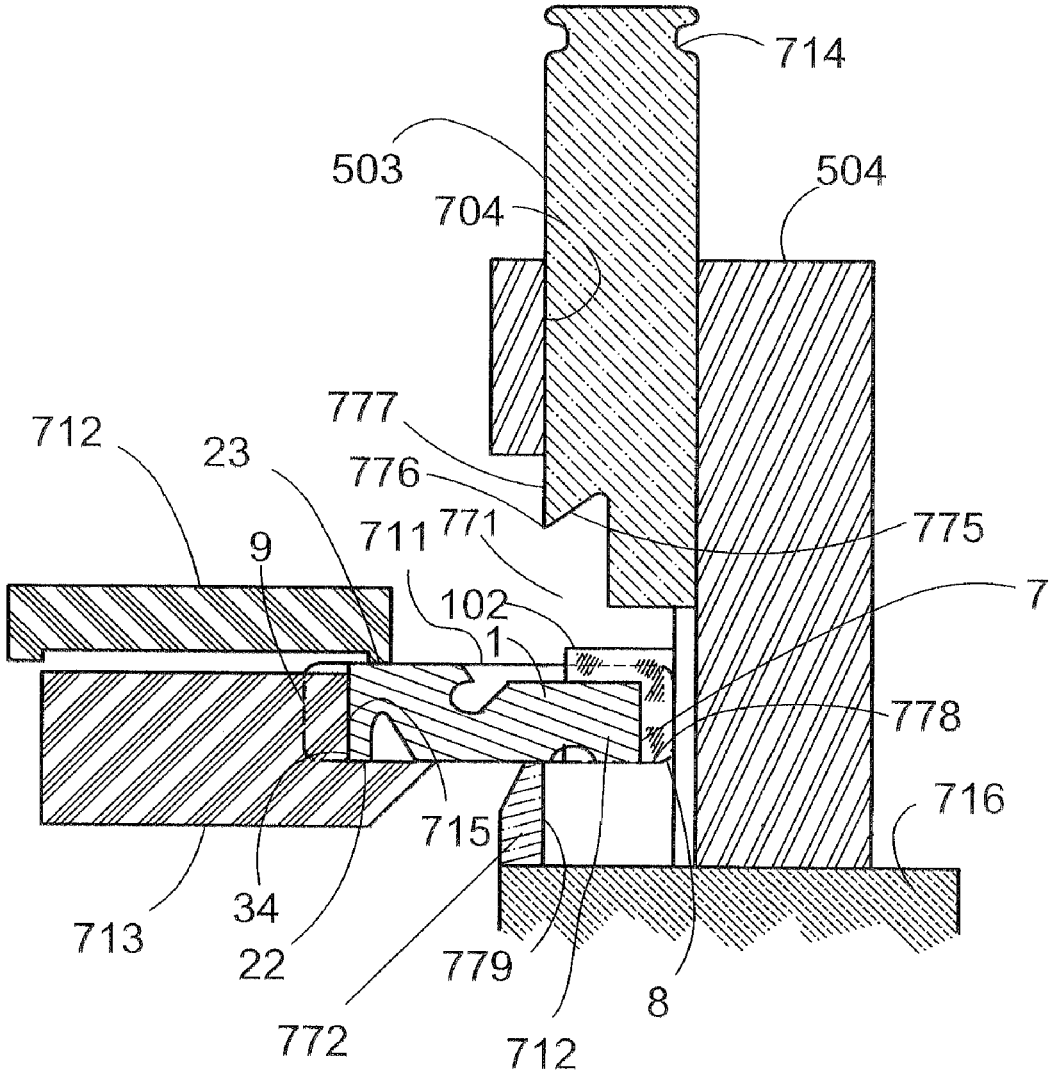
FIG. 7 is a partial section view of an embodiment according to the present invention of the punch and die assembly of a Pro-lok Blue Punch key cutting machine taken through the center of the punch in a forward-rearward direction.

FIG. 7 shows a schematic partial section view of the key punch and jaw assemblies of a modified Pro-lok Blue Punch machine observed right side-to-left side from the tip end of a blank in position to be cut at cross section 2-2 (FIGS. 1 and 2). The blade 1 is positioned horizontally and clamped along its length by upper jaw 712 and lower jaw 713. A conventional screw-type mechanism for bringing the upper jaw 712 down hard against the blank sitting on the lower jaw 713 and thereby clamping the blank between the jaws is not shown. The jaws are in contact with the flat sides 22, 23 near the bottom edge of the blade consequently the blade is oriented such that axis 25 (FIG. 2) is horizontal Preferably, as is the case with Sargent series L and R blanks, the flat sides 22, 23 present a surface at least about 150 mils wide which is suitable for the jaws to clamp the blank with adequate stability for cutting. The bow 3 (FIG. 1) of the blank is hidden behind the flange 711 which forms the top shoulder 8 and the bottom shoulder 9. The vertically oriented punch 503 is designed to fit within a channel 704 of the punch holder 504 so that the punch can slide upward and downward. Thus the cross section of the channel 704 is complementary to that of the punch cross section. The punch is mechanically linked by mechanism not shown near its upper end to the handle 505 (FIG. 5) in a manner that causes the punch to descend when the handle is pressed downward to produce a cut in the blank. An annular groove 714 is cut around the top of the punch to form a lip. The groove and lip permit the linking mechanism to grasp the punch and to enable it to move up and down. A spring maintains the punch in a high position up and away from the die surface 778 until sufficient downward force is applied by the operator depressing the handle. The bottom of the punch is the cutting end 775 which impacts the blade. The cross section of the rearward facing side 777 of the punch has a shape selected to produce the complementary side angle a and bottom shape of the cut (e.g., 32 FIG. 3). The cutting end 775 has an angled profile sloping downward toward the leading edge of the cutting tip 776. That is the cutting end 775 slopes downward from forward to rearward. This slope of the cutting end is believed effective to avoid twisting the blade laterally during the punching step and thus contributes to making clean consistent cuts with minimum amounts of burr formation on difficult-to-cut keys such as the Sargent brand.

The top edge 7 of the blade is cantilevered forward from its clamped position between the jaws. The cantilevered portion 712 of the blade rests upon the upward facing surface 778 of the die 772. A receiving channel 779 in the die has a cross section slightly (approximately 0.001-0.002 inch) larger than that of the punch. This permits operator force on the handle to move the punch downward in channel 704, through the top edge of the blank and into the receiving channel 779, thereby making a cut.

The punch holder, punch and die are mounted in an assembly together on a carriage 716 which moves these parts in concert laterally. The Pro-lok Blue Punch key cutter carriage moves in analogous manner to the carriage of a manual typewriter. That is, initially the carriage is manually moved by the operator to a home position fully to one side by pushing it either left or right, depending on the machine configuration. Stock Blue Punch key cutters can be configured to cut from left-to-right or from right-to-left, but not in both directions by the same machine. Thus a left-to-right cutting configured machine would be pushed fully to the left at the start of a key cutting operation. In keeping with the typewriter carriage analogy, after the handle is depressed to punch through the blank, the carriage automatically moves the punch and die assembly one space in the direction of longitudinal axis 5 (FIG. 1) of the clamped blank. In this way, the punch and die are automatically advanced over the clamped blank to make cuts at positions P1, P2, P3, etc. in succession.

The carriage motion mechanism is conventional for standard Pro-lok Blue Punch machines and therefore will be only briefly described now. An underside of the carriage is milled to have a series of sharply peaked downwardly protruding ridges. A pawl of the frame is biased to extend upwardly into the path of the ridges. A spring means forces the carriage laterally such that the upwardly extended pawl stops the lateral movement of the carriage. As the operator moves the press handle downward to make a plunge cut, a separate vertical rod is driven downward through a dedicated channel in the punch holder. The bottom of the rod pushes the pawl downward beyond the peak of the ridge where it presently resides. The carriage is then free to move laterally under force of the spring means. When the punch handle is allowed to return upward after the cut, the rod also rises which in turn causes the pawl to rise and catch behind the next ridge. This stops the carriage lateral movement at a point where the punch is aligned at the position for the next sequential cut. Thus the carriage advances in ratcheted steps with each plunge of the punch. The manufacturer of the Pro-lok Blue Punch key cutter serendipitously offers standard machines normally designed for cutting brands other than Sargent which have ridge-to-ridge lateral spacing such that the carriage steps exactly 0.156 inch automatically. These machines also have seven lateral steps which permit cutting up to seven positions on a key blank blade. The carriage driving mechanism of a conventional Pro-lock Blue Punch key cutter therefore usually does not need to be modified to permit operation according to this invention.

Figure 13:
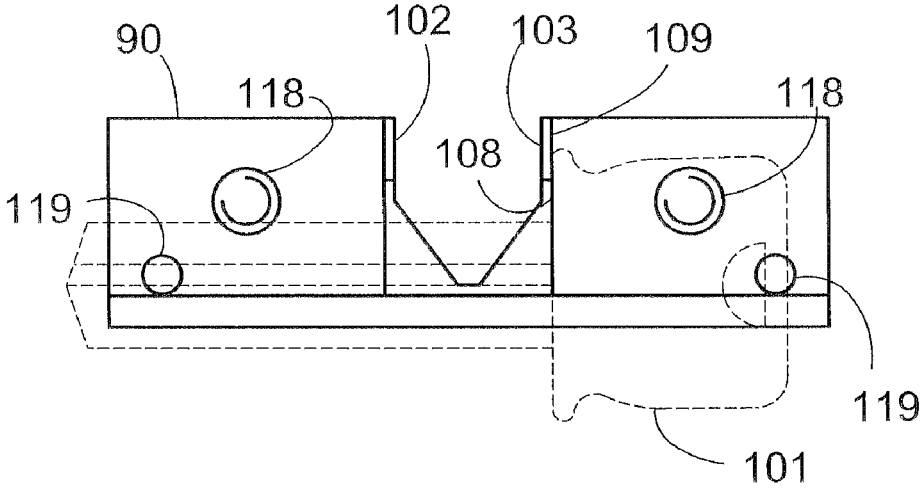
FIG. 13 is a plan view of the die of FIG. 8 showing the relative position of a blank for an "R" series Sargent key about to be cut.
Figure 16:
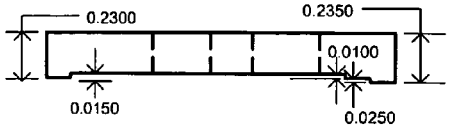
FIG. 16 is a dimension drawing of a side elevation view of an upper jaw for a punch press according to this invention for use with a Pro-lok Blue Punch press body having a carriage that steps to the right.
Figure 18:
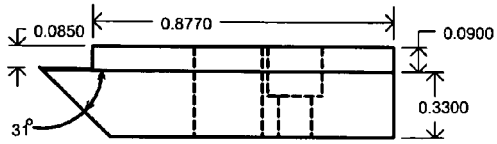
FIG. 18 is a dimension drawing of a side elevation view of a lower jaw for a punch press according to this invention for use with the upper jaw of FIG. 16 in a Pro-lok Blue Punch press body having a carriage that steps to the right.
Figure 17:
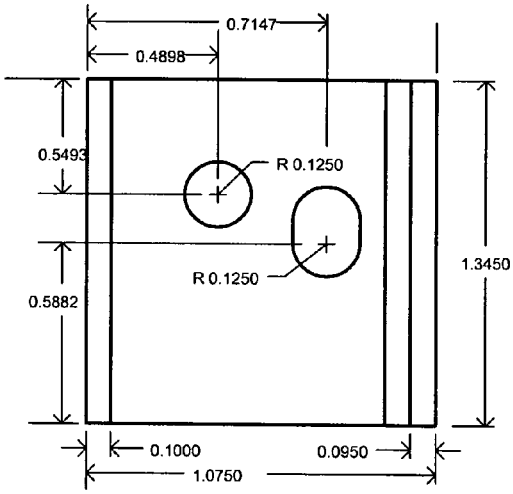
FIG. 17 is a dimension drawing of the bottom view of the upper jaw of FIG. 16.
Figure 19:
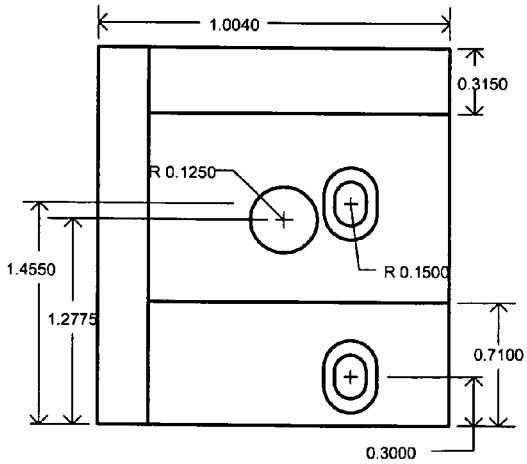
FIG. 19 is a dimension drawing of a top view of the lower jaw of FIG. 18.
Figure 20:
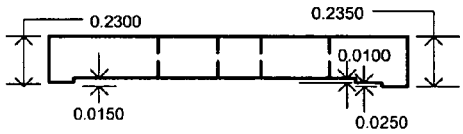
FIG. 20 is a dimension drawing of a side elevation view of an upper jaw for a punch press according to this invention for use with a Pro-lok Blue Punch press body having a carriage that steps to the left.
Figure 22:
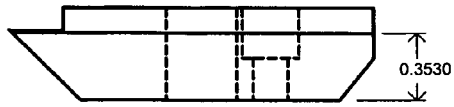
FIG. 22 is a dimension drawing of a side elevation view of a lower jaw for a punch press according to this invention for use with the upper jaw of FIG. 20 in a Pro-lok Blue Punch press body having a carriage that steps to the left.
Figure 21:
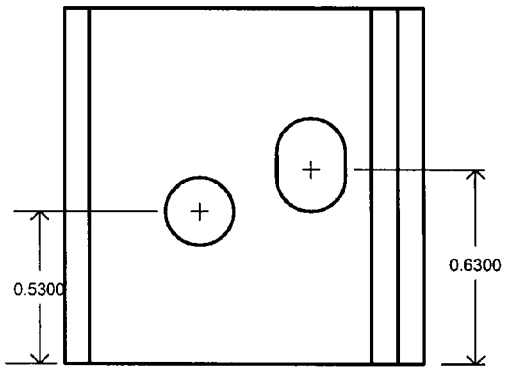
FIG. 21 is a dimension drawing of the bottom view of the upper jaw of FIG. 20.
Figure 23:
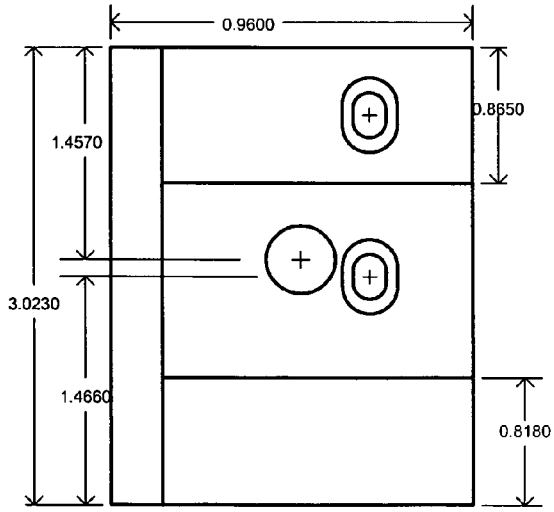
FIG. 23 is a dimension drawing of a top view of the lowerjaw of FIG. 22.

From the preceding discussion and with reference primarily to FIG. 7, it should be understood that a modified Pro-lock Blue Punch key cutting machine operates in the following general way to cut a blank to a specified code. A code bar is inserted from the side of the machine to fit between the backing plate and the sliding bar. The code bar is moved to catch the bead in hole "9". This moves the jaws far forward. With the press handle high, the carriage is moved fully to one side and released so that the spring means sets the carriage in its home lateral position. With the top jaw released a blank key is inserted between the upper and lower jaws. The bottom edge of the blank 34 is pushed against the forward facing wall 715 of the lower jaw. This action indexes the blank forward and rearward in relation to the nip 771 between the punch and die such that the blank is properly juxtaposed to receive a depth of cut corresponding to the code of the mark of the respective hole on the code bar with which the spherical bead is then engaged. While the jaws are still loose, the blank is fixed in lateral position using novel indexing stops according to this invention as will be explained in greater detail below. Basically, the top shoulder 8 is biased against the outboard face of its proximate indexing stop 102 or 103 (FIG. 13). While the bottom edge and top shoulder of the blank are butted directly against their respective indexing surfaces, the upper jaw is clamped down onto the blank with a lever to lock the blank in position between the jaws.

With the blank clamped, key cutting is then performed as follows. The operator moves the code bar left or right until the hole in the bar corresponding to the desired code number for the cut is engaged by the upward driven bead. As the code bar moves, it forces the jaw assembly and accordingly the top edge of the blank forward or rearward respectively toward or away from the nip of the punch and die. When the bead engages the specified code bar hole, the blank is in proper fore-to-aft position under the punch to enable the punch to stamp a cut of required depth according to the key code. The operator gradually but forcefully depresses the handle which plunges the punch cutting tip through the blank and into the receiving channel of the die. When the handle is released, the punch returns to its elevated position while the carriage automatically advances laterally to the next longitudinal cut position. The operator then resets the code bar as appropriate to place the blank in relation to the nip for the next desired depth of cut. The handle is again depressed and released to make the cut and advance the blank by one lateral step. The procedure continues until the blank is completely cut to the full combination of cuts corresponding to the code for a particular key and lock. Thereafter the upper jaw is loosened and the key is removed from between the jaws.

Very importantly, FIG. 7 shows one of two indexing stops 102 projecting upward from the surface 778 of the die. The indexing stops are of central significance for the novel key cutting machine according to this invention and in particular for producing accurate and consistent cuts to code of Sargent brand keys as will now be explained.

Figure 9:
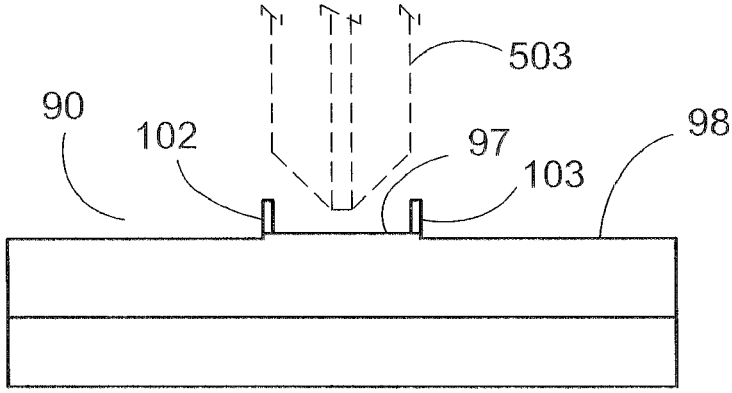
FIG. 9 is a front elevation view of the die of FIG. 8.
Figure 8:
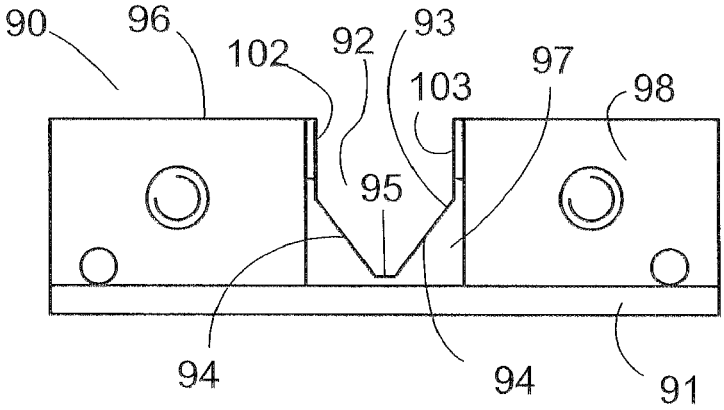
FIG. 8 is a plan view of a die for an embodiment of a Pro-Lok Blue Punch Press key cutting machine modified according to the present invention.
Figure 10:
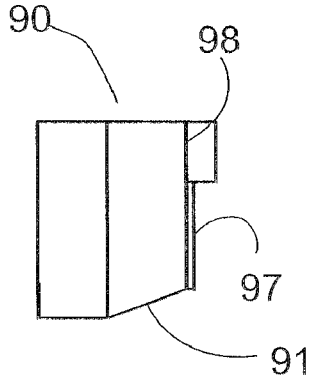
FIG. 10 is a side elevation view of the die of FIG. 8.

The description and function of the indexing stops of the die according to this invention can be better understood with reference to FIGS. 8-12. FIGS. 8, 9 and 10 are orthogonal views of an embodiment of the novel die 90. The die basically is a block of hardened steel having a beveled face 91. Opposite the beveled face and midway along the length, the die forms a cavity 92 which functions as the receiving channel for the punch 503 (shown in phantom, FIG. 8) during key cutting operation. In the illustrated embodiment seen in the plan view (FIG. 8), the cavity 92 defines a flat bottomed, V-shaped profile 93 of which the angled sides 94 and the bottom 95 correspond to the intersecting angles and flat bottom dimensions, respectively, of the punch tip and the cut of the key. For Sargent keys, the angle between sides 94 is 79 degrees and the width of the flat bottom 95 is 51 mils.

FIGS. 8-10 also show that the upward facing surface 98 of the die is partially elevated to form a platform 97 slightly above the remainder of the upper surface of the die 98. The height of the platform is about 10 mils. In the illustrated embodiment, the platform is flush with the rearward edge of the die 96 and extends forward to the bevel 91. The platform extends laterally only a short distance of typically about 0.5 inch centered at the center of the flat bottom 95 of the cut. A primary purpose of the platform is to support the cantilevered blank so that the punch plunging downward during a cut does not take the part of the blade near the cut downward to deform the end view profile of the blade. Thus one of ordinary skill in this art will recognize that the die should be shimmed such that the top of the platform meets the underside of region "B" (FIG. 2) of the blank when the key is clamped by the jaws. A secondary purpose is to allow any chips of cut away blank material or burrs at the edges of the cuts to be released into the approximately 10 mil gap between the blank and the die as the carriage moves between cutting positions. Without the platform, such chips and burrs could gouge the blade or generate larger burrs that would interfere with operation of the key in its lock.

A pair of indexing stops 102 and 103 is mounted on the upper surface 98 outboard of the cavity such that one indexing stop is on each side of the punch. The indexing stops are used to align the blank laterally at the start of a key cutting operation as will be described in greater detail below. The indexing stops are typically positioned forward on the die and proximate to the sides of cavity 92. The indexing stops should be large enough to bear against the top shoulder 8 (FIG. 7) of the blank but not so large as to interfere with other parts of the machine. That is, the stops should fit safely vertically between the upper surface of the die and the lower surface of the punch holder. Accordingly, the height of the indexing stops, i.e., the distance the stops protrude above the upper surface 98 of the die, should be about the thickness of a key. A preferred maximum height of the indexing stops is about 0.3 inch. Preferably the indexing stops rise to a height above that of the platform 97 and more preferably to at least about 0.1 inch above surface 98. If the indexing stops rise too little above the die surface, the blank may slide away from contact with the stop during set up for cutting which can lead to failure to precisely space the cut at position P1 from the top shoulder. In a preferred embodiment, the indexing stops are thin rectangular flat plates and the dimensions of each such flat plate indexing stop is about 0.0445 inch thick, about inch high and about 0.1686 inch long.

Figure 12:
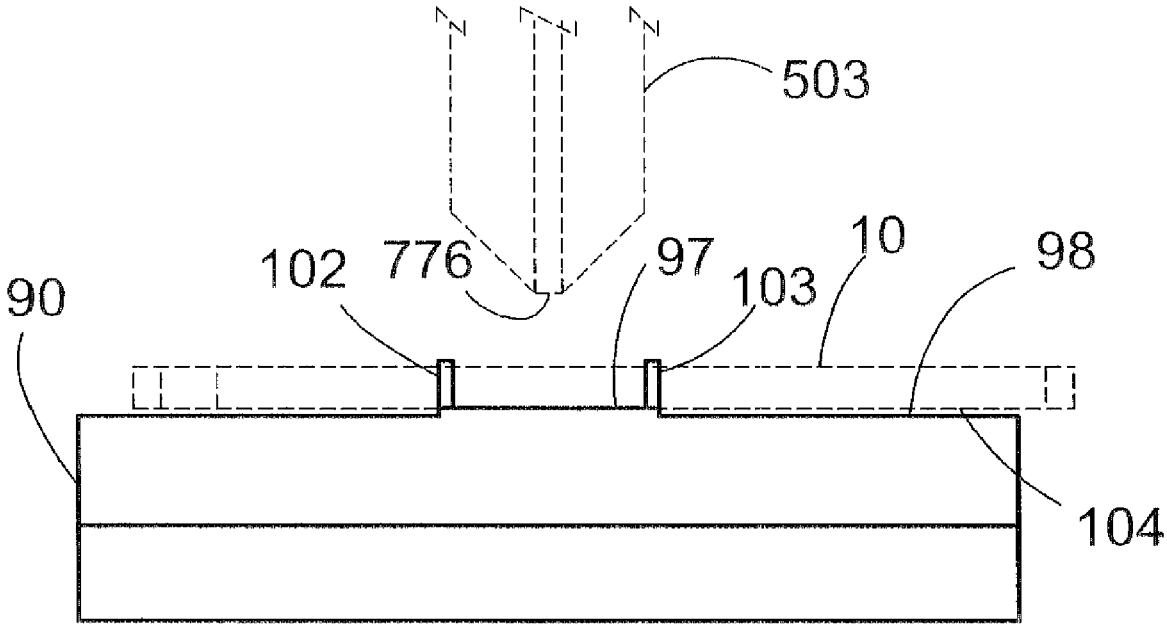
FIG. 12 is a front elevation view of the die of FIG. 11 showing relative position of the blank about to be cut by a punch.
Figure 11:
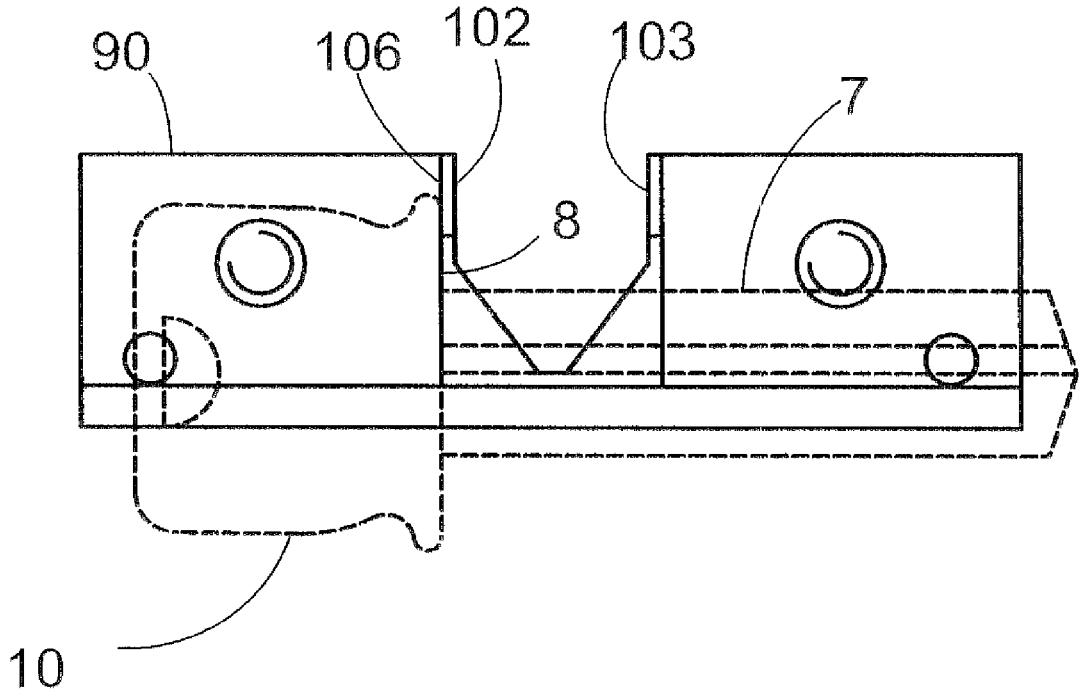
FIG. 11 is a plan view of the die of FIG. 8 showing the relative position of a blank for an "L" series Sargent key about to be cut.

To illustrate the position of the key and punch relative to the die, FIGS. 11 and 12 show the die 90 of FIGS. 8 and 9 in plan and front elevation views, respectively, with a key blank 10 in phantom dashed lines positioned on the die. The cutting end of a punch 503 is shown in phantom by dashed lines in FIG. 12 with cutting tip 776 poised above the blank and die. The area B (FIG. 2) near top edge 7 of the blank, however, does rest upon the platform 97 as perhaps better seen in FIG. 7. FIGS. 11 and 12 further show that the top shoulder 8 of the blank is in direct contact with the outward face 106 of left indexing stop 102. Thus the blank is in proper lateral alignment for commencing a cutting operation in accord with the practice of this invention.

The fact that the indexing stop is mounted on the die enables it to bias against the top shoulder of the key. This is significant for Sargent keys which have the cutting positions (i.e., P1, P2, P3, etc.) indexed relative to only the top shoulder. For unknown reason, the bottom shoulder of Sargent key blanks may be laterally offset from the top shoulder by an inconsistent distance such that aligning the initial cutting position with the bottom shoulder of such a blank will usually produce a key cut to code that fails to operate its intended lock. It is the top shoulder that butts against the face of the lock when a key is insert. Hence a Sargent key with improper distance between the top shoulder and the first cut can fail to operate the lock because the cuts will not line up with their respective pins when the key is pushed fully into the lock such that the top shoulder contacts the lock face.

Figure 15:
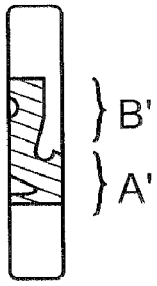
FIG. 15 is a section view of a Sargent "R" series blank which has an end view profile that is a mirror image to the blank of FIG. 2.

It is usual to cut a key blank from bow to tip. That is, the first cut is at position P1 (FIG. 3), the next at P2 and so on. FIGS. 11 and 12 show a Sargent "L" series blank mounted on the novel die. A Sargent L series key has an end view profile as shown in FIGS. 1 and 2. This type of key is characterized by the flat blade parallel surfaces (area "A", FIG. 2) being present near the bottom edge of the blade with the blade oriented such that the bow is on the left and the tip is on the right. For comparison, a Sargent "R" series blank, as shown in FIG. 15, has a mirror image end view profile to that of the L series. It is thus characterized as having its flat blade parallel surfaces being present near the bottom edge of the blade with the blade oriented such that the bow is on the right and the tip is on the left. As evident from the disclosure above, the Prolock Blue Punch press with novel modifications operates by clamping the flat blade parallel surfaces at the bottom of the blade and by stepping from one punch cut position to the next in one direction only.

The Sargent L series blank of FIGS. 11 and 12 can be cut from bow to tip provided that the carriage is one which steps from left to right. The general procedure described above for mounting a blank in the machine and cutting the blank to code would be specifically applied to the example of FIGS. 11 and 12 as follows. The code bar for Sargent depth of spacings is inserted against the backing plate and the code bar is slid to depth hole number 9 to move the jaws far forward. The carriage is moved to left to its home position. With the bow on the left side, the bottom edge of the blank is butted against forward facing wall on the lower jaw (not shown) and simultaneously top shoulder 8 of the blank is set against the outboard face 106 of the left indexing stop 102 precisely as shown in these figures. In operation, the jaws and blank remain fixed and the punch and die carriage steps to the right by one cut position with each plunge of the punch. For a Sargent key, the center line of the first position P1 is exactly 0.215 inches from the top shoulder. The incremental spacing is 0.156 inch between successive cut positions, i.e., between P1-P2, P2-P3, P3-P4, etc. Therefore, with each cut the carriage of this example moves 0.156 inch to the right.

A feature of the novel modifications is that they render a key cutting machine that is configured to cut an "L" series blank from bow to tip, i.e., with carriage moving stepwise left to right, to also cut an "R" series blank without further modification. This is a significant advantage to locksmiths who may use a single machine to reliably and consistently cut to code these two very popular and otherwise difficult to cut key series. Coupled with the advantage that the novel key cutter is portable, light weight and manually operable, i.e., without electrical power, the novel machine represents a substantial advancement for the industry which formerly had to rely upon keys ordered from the original brand manufacturer or, provided the key code did not incorporate high MACS values, cut by third parties using expensive, bulky electrically powered cutting machines.

Figure 14:
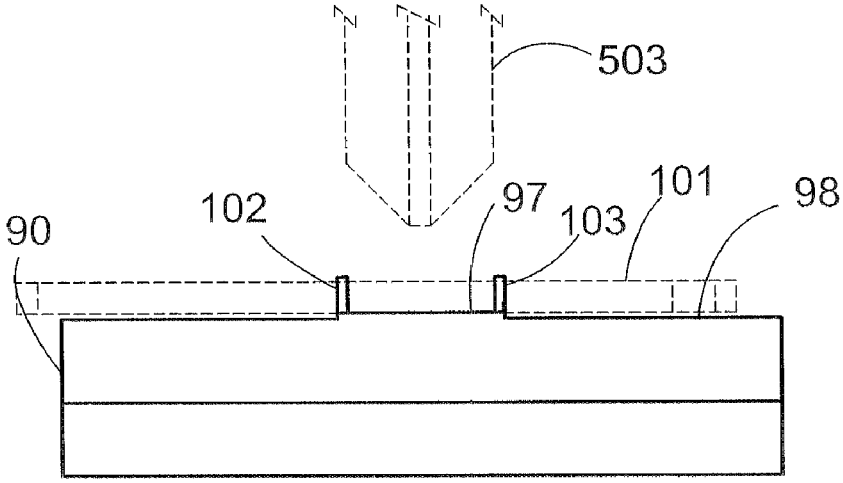
FIG. 14 is a front elevation view of the die of FIG. 13 showing relative position of the blank about to be cut by a punch.

A set up for cutting a Sargent "R" series blank 101 can be understood with reference to FIGS. 13 and 14. Here the die is exactly the same as in FIGS. 11 and 12. Because the end view profile (FIG. 15) of the blade is a mirror image of the "L" series blade, simply placing the blank into the jaws so that the tip extends to the right from the bow (as in FIG. 11) will not produce a well-cut key. This is because the top edge region B' of the blade which will not lie on the platform 97 of the die when the bottom edge area A' of the R series blade is clamped by the jaws. In that case, the plunging punch will distort the cuts and cause excessive burr formation to the extent that the key will likely not fit the lock. However, the top edge area of the blade will ideally contact the platform if the blank is mounted in the jaws with the "R" series blade extending from bow on the right to tip on the left as shown in FIG. 13. In this way, the top edge of the blade faces forward toward the punch and die.

The purpose of the second indexing stop 103 is now evident. It can be used to place the "R" series blank in lateral alignment in preparation to receive a first cut. This is done according to the following steps. The code bar is inserted into the machine and set to the No. 9 hole. This drives the jaws forward so that when the blank is later clamped in the jaws, its top shoulder will be in line with the indexing stops forward on the die. The carriage is stepped fully to the right by repeatedly depressing the press handle. With jaw compression released by manipulating the jaw control handle, the blank is inserted in the orientation seen in FIG. 13. While holding the bottom edge of the blade against the forward facing wall of the lower jaw (not shown), the left-facing top shoulder 108 of the "R" series blank is moved into direct contact with the outboard face 109 of the second indexing stop 103. Then the jaws are clamped together to hold the blank in place.

The punch and die bearing carriage of the Pro-lok Blue Punch machine for cutting predominantly "L" series Sargent keys only steps from left to right. Consequently, an "R" series Sargent blank mounted in the machine as described in the preceding paragraph should be cut in the atypical fashion from tip to bow. This is accomplished by next sliding the carriage to the extreme left after clamping the "R" series blank in the jaws. The nip of the punch and die will then be located at the most extreme, (i.e., its "home") position at the tip of the blade, i.e., the P7 (FIG. 3) position along the blade. It is now disclosed that basic Pro-lok Blue Punch machines of which the novel key cutting invention is an improvement typically is set by the manufacturer to step through seven spacing steps. However, the Sargent key combination may call for seven cuts but normally has six and sometimes only five. That is, the cuts occur at locations P1-P5 for five cuts, or more typically at positions P1-P6 for six cuts. In that event, it is part of the process of cutting an "R" series key on an "L" series configured machine to take a first, and possibly second, "empty cuts" which moves the carriage a corresponding number of spaces from the P7 position. This is accomplished by sliding the code bar to lock at hole "1" (FIG. 6) corresponding to the "D1" (FIG. 3) zero depth of cut and then pressing down the cutting handle one time for each space that the carriage is to be moved. The punch will not take any cut out of the blade but the carriage will advance to place the nip at the proper position to make a first cut. Then the code bar should be slid to lock at the appropriate hole number for the depth at the corresponding position, (P6, P5 etc.). The cutting procedure for an "R" series blank is subsequently identical to that for an "L" series blank except that the cut is executed in reverse position order, (i.e. P6, P5, P4, P3, P2, P1) in view that the carriage continues to step toward the bow with each punch of the press.

Primary physical attributes of the novel modifications to the Pro-lok Blue Punch key cutting machine which permit a single machine to cut both "L" and "R" series Sargent key blanks are (i) placing indexing stops on the die, (ii) positioning two indexing stops on the die at opposite sides of the punch from each other, and (iii) setting the indexing stops laterally apart by twice the distance between the top shoulder of the blank and the first cut position P1. Attribute (i) is significant because it places the top shoulder of Sargent blanks at an exact lateral position relative to the center of the punch. This is instrumental is making the first cut precisely spaced from the top shoulder which cause the key to insert to the proper extent into the corresponding lock. If the distance between the top shoulder and the first cut is too large, it will be necessary for the user to only partially insert the key into the lock to a distance determined by trial and error to make the key work. If this distance is too small, the key will not work in the lock at all because the top shoulder will butt against the face of the lock preventing the cuts to insert far enough into the lock to accept their respective pins. Attribute (ii) allows mirror image end view profile blanks such as the Sargent "L" and "R" series blanks to both index to their correct lateral positions in a single Pro-Lok Blue Punch machine. Attribute (iii) importantly sets the exact first cut-to-blank shoulder distance for both "L" and "R" series blanks inserted from opposite sides of the machine without requiring intricate setting of the indexing stops.

In this regard, the distance between the top shoulder and the first cut position, P1 for Sargent "L" and "R" keys is 0.215 inch. To create a die for cutting Sargent blanks, the distance between outboard face 106 of indexing stop 102 (FIG. 11) and outboard face 109 of indexing stop 103 (FIG. 13) should be 0.430 inch. Thus, regardless of whether a blank is inserted in the machine with its bow to the right or the left the first cut will be accurately indexed to be 0.215 inch from the top shoulder. With indexing stops of such dimensions the die can be easily installed on the punch and die carriage, basically as follows. The die is placed in approximate position relative to the punch on the carriage. Set screws in pre-drilled holes 118 are threaded into mating holes in the carriage to roughly secure the die in position. The punch should have cross section dimensions that provide about 0.001-0.002 inch clearance with the receiving channel of the die. The punch can be worked up and down to assure that it travels smoothly and freely into the receiving channel. Roll pins are then forced into holes 119 to further fix the position of the die relative to the carriage. As mentioned, once the die position relative to the punch is set in this manner, both "L" series blanks inserted with bow on the left of the punch or "R" series blanks inserted with bow on the right of the punch will automatically index to the proper shoulder to first cut position (0.215 inch) by butting the top shoulder of the blank against the adjacent indexing stop.

As disclosed above, a basic Pro-lok Blue Punch machine body obtained from the manufacturer is only capable of advancing the punch stepwise in one direction, for example, from right to left. Such a left-stepping machine can be configured according to this invention with a die, punch and code bar to cut from bow to tip, i.e. in sequence order from P1 to P7, Sargent "R" series blanks inserted with bow to the right of the punch. The same left-stepping machine will also cut Sargent "L" series blanks inserted with the bow to the left of the punch. However, the "L" series blanks will be cut from tip to bow in sequence order from P7 to P1. Thus this invention enables the operator to cut Sargent keys according to various preferences. For example, a first locksmith who prefers to cut the most common "L" series keys from tip to bow can utilize a left-stepping Pro-lok Blue Punch modified according to this invention. The same machine will permit the locksmith to also cut "R" series Sargent blanks from bow to tip. A second locksmith might prefer to cut Sargent "L" series blanks from bow to tip. The second locksmith can do this using a right-stepping modified Pro-lok Blue Punch press and preserve the ability to also cut Sargent "R" series blanks on the same machine. The "R" series blanks will cut in the right-stepping modified Pro-lok machine from tip to bow. The novel modifications to the Pro-lok Blue Punch manual key punch machine thus provide locksmiths with great flexibility in choosing the manner by which heretofore previously difficult to cut keys can be manually punched with accuracy and consistency.

To modify a standard Pro-lok Blue Punch manual key cutting machine according to the present invention, one starts with a complete standard machine obtained from the manufacturer with all parts except the code bar, upper jaw, lower jaw, die, punch and key gauge. The selected machine should have a 0.156 inch stepping increment suited to cut Sargent keys to proper position spacing. A key gauge for the type of key being cut is normally mounted on the rear of the frame as a courtesy. The key gauge has precision sized slots with dimensions that correspond to the cut dimensions so that a user can decode an existing key by inserting it into the gauge to measure the cut depth at each cut position. For example, among the slots for all the cuts from 1-10, the gauge for a Sargent key would have a gap of 0.270 inch corresponding to the key dimension from bottom of the blade to the flat bottom of the cut for a No. 4 depth of cut. Providing a key gauge for Sargent keys or a solid sheet to cover the space vacated by the non-existent key gauge is optional.

The die, punch and code bar should be fabricated according to the design and dimensions of the above disclosure to permit cutting of Sargent brand keys. The upper and lower jaws are substantially identical in configuration to those of standard Pro-lok jaw pieces. However, the jaws are laterally dimensioned so that they do not cause the bottom shoulders to butt against the jaws when indexing the top shoulder against the corresponding indexing stop on the die. This is to assure that the top shoulder of the blank can always butt against the indexing stops on the die without interference between the bottom shoulder and the end of the jaws. Also, the jaws should be made appropriately wide to maximize the clamping surface on the bottom edge of a blank. For this reason, the jaws on a left-stepping machine may be laterally offset in comparison to the jaws on a right-stepping machine. Dimensions for an upper and lower jaw for use in a right-stepping machine according to this invention are shown for example in FIGS. 16-19. Similarly, dimensions for an upper and lower jaw for use in a left-stepping machine are shown in FIGS. 20-23. Dimensions are in inches.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

I claim:

1. In a manual press for cutting a key blank having a bow defining shoulders having a shoulder thickness, and a relatively narrow elongated blade adjacent the bow which defines a longitudinal axis of the key blank and a plurality of cut positions along the axis separated by a between center cut spacing, the press comprising (a) a jaw assembly comprising a lower jaw and an upper jaw operative to removably clamp the blade therebetween such that a cantilevered edge of the blade to be cut extends forward of the jaw assembly, (b) a carriage automatically movable in one lateral direction parallel to the axis of the blade of a blank clamped in the jaw assembly in successive steps of the between center cut spacing, (c) a punch with a male cross section plunge motion-mounted in a holder on the carriage, and (d) a die mounted on the carriage, the die having a substantially flat upper surface comprising an elevated platform supporting one side of the cantilevered edge of the blade, the die defining a rearward indented receiving channel complementary in shape to the punch cross section such that manual lever actuation is effective to plunge the punch toward the die through the cantilevered edge of a blade positioned between the punch and die into the receiving channel, effectively to cut a notch in the cantilevered edge, in which the improvement comprises the die having two indexing stops protruding upward perpendicular from the substantially flat upper surface by an elevation distance of about the shoulder thickness and positioned at a distance from the jaw assembly effective to bias against a shoulder of a key blank clamped in the jaw assembly, and in which each indexing stop is disposed on a laterally opposite side of the punch from the other indexing stop.

2. The manual press of claim 1 in which the key blank defines a first cut distance between a top shoulder and the cut position closest to the top shoulder, and in which the indexing stops each have a laterally outward face and are located on the die such that the outward faces are separated by exactly twice the first cut distance.

3. The manual press of claim 2 in which the outward faces of the indexing stops are separated by 0.4300 inch.

4. The manual press of claim 2 in which the punch has a cutting tip with a forward facing, flat-bottomed, V-shaped cross section defined by an internal angle of 79 degrees and a bottom width of 0.0520 inch.

5. The manual press of claim 4 in which the between center cut spacing is 0.156 inch.

6. The manual press of claim 5 which further comprises depth setting means for moving the jaw assembly forward and rearward by discrete whole number multiples of an incremental depth of cut.

7. The manual press of claim 6 in which the depth of cut is 0.020 inch.

8. The manual press of claim 1 in which the key blank has an end view profile of a Sargent "L" series or "R" series key.

* * * * *